United States Patent [19]

Sagemüller

[11] Patent Number: 4,467,970

[45] Date of Patent: Aug. 28, 1984

[54] APPARATUS FOR CUTTING PLANT MATERIALS, IN PARTICULAR TOBACCO

[75] Inventor: Franz Sagemüller, Bockhorn, Fed. Rep. of Germany

[73] Assignee: Franz Sagemüller GmbH, Bockhorn, Fed. Rep. of Germany

[21] Appl. No.: 397,932

[22] Filed: Jul. 13, 1982

[30] Foreign Application Priority Data

Jul. 14, 1981 [DE] Fed. Rep. of Germany ..... 3127697

[51] Int. Cl.[3] ..... B02C 18/18

[52] U.S. Cl. ..... 241/101.2; 241/223; 241/241; 241/300.1

[58] Field of Search ..... 241/101.2, 241, 223, 241/224, 239, 240, 300.1

[56] References Cited

U.S. PATENT DOCUMENTS 2,130,473 9/1938 Ruau ..... 241/241 X 2,139,868 12/1938 Thieman ..... 241/101.2

2,848,030 8/1958 Rudszinat ..... 241/101.2

3,354,921 11/1967 Elsner ..... 241/101.2

*Primary Examiner*—Mark Rosenbaum

*Attorney, Agent, or Firm*—Collard, Roe & Galgano

[57] ABSTRACT

There is provided an apparatus for cutting plant material, in particular tobacco, having a funnel-shaped press in which the charged material to be cut is compressed and fed to a mouthpiece arranged at the outlet end of the press, a knife carrier rotating about a horizontal axis in front of the mouthpiece and having circulating knives which move past the mouthpiece so as to perform a cutting action, a knife grinding device disposed in the circulation path of the knives, and counter knives disposed on the mouthpiece at the outlet end of the press projecting into the circulating path of the circulating knives. The knives are thereby sharpened on two edges by the knife grinding device and the counter knives.

17 Claims, 5 Drawing Figures

APPARATUS FOR CUTTING PLANT MATERIALS, IN PARTICULAR TOBACCO

The invention relates to an apparatus for cutting plant material, in particular tobacco, with a funnel-shaped press in which the charged material to be cut is compressed and fed to a mouthpiece arranged at the outlet end of the press, with a knife carrier preferably rotating about a horizontal axis in front of the mouthpiece and having circulating knives which may be moved past the mouthpiece so as to perform a cutting action, and with a knife-grinding device disposed in the circulation path of the knives.

Plant materials, such as herbs and the like which are also referred to as drugs, but in particular tobacco, may be cut with apparatuses of the above-described type. Cutting represents the most intense mechanical interference with the structure of the material to be cut. For example, in the process of cutting tobacco, a certain proportion of dust is inevitably produced, which is apparent as a loss which causes a decrease in value. For example, in subsequent processes, the proportion of dust may carbonize in calcining drums or lead to an undesired discoloration of the tobacco.

The cutting procedure is performed with a high surface pressure between the cutting edge and the tobacco. The amount of tobacco which forms the proportion of dust and which is subject to this extreme degree of surface pressure, depends upon the cutting surface of the knife cutting edge which is blunt to a certain extent and is increased by wear with time. The blunter the cutting edge, the greater the cutting surface and consequently the dust proportion of the cut tobacco.

In known apparatus for cutting plant materials, in particular tobacco, therefore, a knife-grinding device, by which the cutting edges are sharpened after each cutting, is disposed in the circulation path of the knives.

The grinding wheels of the knife-grinding devices have as fine as possible a grain so as to permit an optimum sharpening of the cutting edges of the knives. Fine-grained grinding wheels have the disadvantage, however, that they lose the optimum grinding action relatively rapidly, particularly since the edges of the knives become most soiled in the immediate vicinity of the cutting edges to be ground, as tobacco juice and tobacco constituents are pressed particularly hard into the grinding lines already present there and harden and they first have to be removed by the grinding wheels before the abrasive grains can attack the metal of the knives. The grinding wheels must therefore be sharpened to an increased extent, as a result of which their service life is reduced to approximately between a tenth and a twentieth of the service life of a grinding wheel without soiling.

The object of the invention is to improve an apparatus for cutting plant materials, in particular tobacco, in such a way that by more expedient sharpening it is possible to reduce the proportion of dust formed during cutting.

This object is attained according to the invention in that a grinding wheel of the knife-grinding device is in operative connection with the oblique knife surface, the from the mouthpiece, and elastically resilient counter knives projecting into the circulation path of the cutting edges of the knives are disposed on the mouthpiece.

This results in the advantage that the resilient counter knives are held bearing resiliently against the cutting edges of the knives while the said cutting edges are moved past, i.e. during a cutting operation, so that there is an optimum shearing action upon the material to be cut. On account of the shearing surfaces of the cutting edge of the knife and the corresponding counter knife, held resting against one another during cutting, a so-called "self-sharpening cutting" takes place, since, as the cutting edge of the knives moves past, the counter knives are resiliently deflected, press in passing cutting edge and spring back into the normal position after the cutting edge has passed.

The advantage essential to the invention is therefore the combination of the automatic grinding and the sliding sharpening by the counter knives at each revolution of the knives.

In a preferred embodiment it is provided that each counter knife is formed as a steel bar which is held clamped on the mouthpiece and one longitudinal edge of which projects towards the circulation path of the cutting edge of the knives. In this way the counter knives may be changed relatively simply when worn or the like. In addition, the resilient elasticity of the counter knives may be affected by the choice of the clamping length, so that optimum cutting performances may be set.

According to a second solution of the basic object, for which independent protection is also claimed, it is also possible to optimize the cutting by virtue of the fact that a grinding wheel of the knife-grinding device is in operative connection with the oblique knife surface, the knife face, facing away from the material to be cut emerging from the mouthpiece, and that at least one of the two approximately horizontal free edges of the mouthpiece on the discharge side projects at least partially into the circulation path of the cutting edges of the knives.

In the case of this step according to the invention, the cutting edges of the revolving knives advantageously slide past edge areas of the mouthpiece itself which project accordingly into the circulation path, so that as they pass the knives must yield elastically resiliently. Either one or both of the edges of the mouthpiece may of course be used for the advantageous sliding effect.

According to a further development of this solution the area projecting into the circulation path of the cutting edges of the knives is formed by the free front face of a strip placed in front of the upper edge of the mouthpiece. Such a strip is arranged in such a way that its free front face is orientated approximately tangentially to the circulation path but is set forward to a predetermined extent towards the center of the circulation path. Each knife thus strikes against the strip and is increasingly deflected, and the contact pressure producing a sliding action is constantly increased in accordance with the inherent resilience of the knife. The lower edge of the mouthpiece may also of course be provided with a projecting sliding strip.

Carbide metal is suitable as a material for the sliding strips.

In the event of a lower sliding strip also being used, the edge thereof forming a counter knife is provided with a bevel which effects the desired deflection of the cutting edges of the knives until the latter may be moved past the strip in a sliding manner.

Each knife may be formed as a steel bar held clamped in clamping elements of the rotating knife carrier and having a sharpened longitudinal edge acting as a knife-edge. The cutting edge of the steel bars held clamped in the clamping elements projects to as short an extent as possible from the said clamping elements in order to prevent the knives from bending and breaking during cutting.

The longitudinal edges of the knives opposite the cutting edges are preferably clamped in clamping shoes which are movably guided approximately transversely to the axis of rotation in the rotating knife carrier. On account of this step a steel bar used as a knife may be moved forward in the clamping elements in order to compensate the reduction in the knife cutting edges ground away by the grinding device at each revolution of the knife.

The steps described above may also be applied in the case of a cutting device which performs a so-called "rotating guillotine cutting", i.e., the knives are clamped at the periphery of a cylindrical knife carrier and revolve with the rotation of the said knife carrier.

In addition, there are also cutting devices, in particular for tobacco, which operate with the so-called "chopping" or "guillotine cutting", i.e. the knife is moved past the mouthpiece in an approximately straight line. In order to carry out this form of cutting, machines are known in which there is likewise a rotating knife carrier but the individual knives of this knife carrier are held parallel to one another as they revolve around the axis of rotation. For this purpose appropriate rod systems are incorporated in knife carriers which permit such articulation and guidance of the knives for a parallel cutting. The steps according to the invention are preferably applied in the case of cutting machines of this type.

In the case of an apparatus with a knife carrier which has knives guided parallel to one another, additional advantages may be obtained by the fact that each clamping shoe is combined with the knife and associated clamping element to form a structural unit which is mounted in the rotating knife carrier in such a way as to be pivotable about an axis extending parallel to the axis of rotation.

While the knife carrier completes a revolution, it is possible, by pivoting the structural unit holding the knives about the axis extending parallel to the axis of rotation, for the knife always to be held parallel to that position which it occupies while moving past the mouthpiece, i.e. during the cutting procedure. This may be effected for instance by each structural unit having a guide system, for example a rod system, for pivoting it, which is moved dependently upon the rotational movement of the knife carrier.

In order to achieve the compensation, already described, of the reduction of grinding edges of the knives by grinding away upon each revolution in the case of a cutting apparatus with knives which rotate but which are guided parallel to one another, it is provided that an adjusting spindle constantly advancing the associated knife acts upon each clamping shoe. This adjusting spindle may, for example, act upon a split nut on the clamping shoe, so that as the adjusting spindle is rotated the steel bar acting as a knife is moved forward relative to the clamping elements. The adjusting spindle must thus be able to overcome the static friction produced by clamping in the clamping elements. This may be achieved by suitable measures, for example smooth mutual bearing surfaces.

Each adjusting spindle is connected to an advancing gear system. It is known to use rod systems actuated by working cylinders as an advancing gear system. The accommodation of working cylinders with the supply lines for the pressure medium inside a rotating knife carrier, however, makes it necessary to overcome considerable structural difficulties.

According to a further development of the invention, it is provided, therefor, that the advancing gear system is a set of planetary gears independent of the rotation of the knife carrier. This set of planetary gears may be arranged in such way that one planet wheel of a set of planetary gears secured to the pivoting axis of the structural unit is associated with each adjusting spindle, that a sun wheel of the set of planetary gears is mounted on the axis of rotation of the knife carrier, that the sun wheel and the planet wheel are connected to one another by way of a toothed belt and that the sun wheel may be rotated by way of an advancing rotating drive effecting the advance of the knives.

This results in the advantage that as the knife carrier rotates about its axis of rotation both the planet wheels and the sun wheel are moved about the same axis, i.e. the axis of rotation. Neither the sun wheel nor the planet wheel completes a revolution about its own axis. Only if the sun wheel is rotated by a rotating drive connected thereto, for example an electric motor disposed in the knife carrier, independently of the rotational movement of the knife carrier itself, is this rotational movement transmitted via the toothed belt to the plant wheels, and the adjusting spindles connected thereto are rotated, so that a uniform advance of all the knives on the knife carrier may be achieved.

While cutting material to be cut emerging from the mouthpiece the cutting edges of the knives held in the knife carrier and the counter knives of the mouthpiece slide past one another. These parts are formed by steel rods and are therefore relatively sensitive. If the cutting pressure is too great damage may quite possibly be caused to the knives. In particular, the material to be cut may also contain thick pieces of wood and even stones which could seriously damage not only the knives but also the entire machine.

In order to avoid damage of this type the apparatus is advantageously characterized in that the press may be tilted together with the mouthpiece about an axis orientated parallel to the axis of rotation of the knife carrier. This step has the advantage that when a predetermined value of the cutting force is exceeded the entire press is displaced by the knives of the knife carrier acting upon the counter knives of the mouthpiece and is tilted away downwards. Such overload values are preferably set in such a way that damage of the cutting tools or the apparatus itself can never occur.

The disengagement in the case of a predetermined excess load may, for example, be achieved by the press being supported on a disengageable support element which is provided with an adjustment device for the threshold value of a supporting force which effects disengagement in the event of overloading.

The center of rotation, about which the entire press can tilt if the cutting tools are overloaded, is disposed relatively high above the position of the axis of rotation of the knife carrier, in order that the mouthpiece with the counter knives immediately clears the circulation path of the cutting edges of the knives of the knife carrier when the press is tilted away. Pivoting the press about the elevated tilting axis may also advantageously be used to adjust the abutment of the counter knives against the passing cutting edges of the knives of the knife carrier. The mouthpiece and the counter knives can thus be set by adjustable pivoting about the tilting axis of the press more or less with respect to the circulation path of the cutting edge.

An example of embodiment of the invention, in which further inventive features are disclosed, is illustrated in the drawings, in which.

Figure 1:
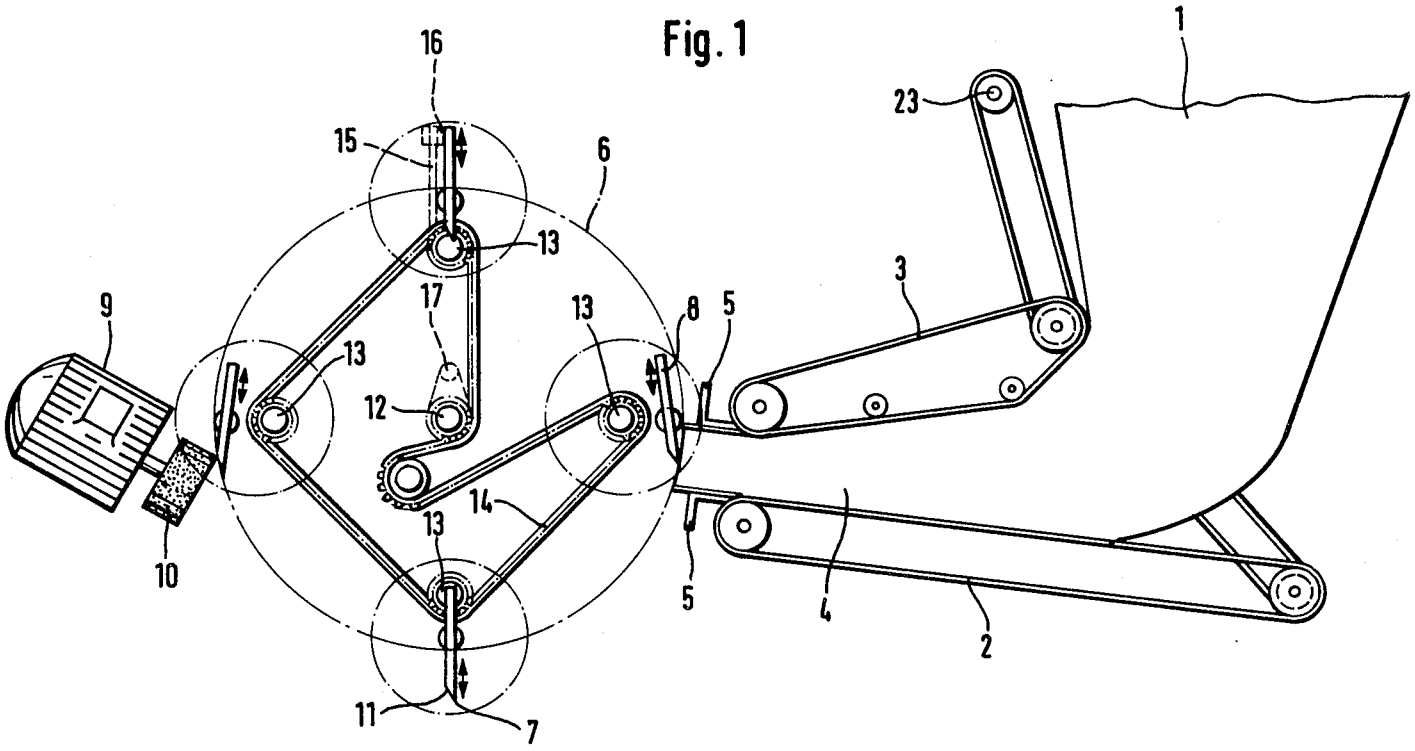
FIG. 1 is a diagrammatic side view of an apparatus for cutting tobacco according to the invention.

A diagrammatic side view of an apparatus for cutting tobacco is shown in FIG. 1. The material to be cut is poured loosely into the funnel 1. The press, which comprises a lower conveying means 2 and an upper conveying means 3, is disposed at the mouth of the funnel. Both conveying means are arranged in such a way that a passage 4 which narrows in the feed direction of the material to be cut is formed between the strands of the circulating belts facing one another, and a mouthpiece 5 is disposed at the end of the said passage 4. The material to be cut emerges from the mouthpiece 5. The outlet opening of the mouthpiece is located on a circulation path 6 of the cutting edges of knives 8 which are held in a rotating knife carrier not shown in greater detail. In this example of embodiment the knife carrier has four knives 8.

The knives are held by components known per se which are not described in detail and which are movably disposed in the knife carrier. The movability is provided in order to keep the knives approximately in the same position on the circulation path 6 during their circulation effected by the rotation of the knife carrier, i.e. all the knives 8 are approximately parallel to one another during the circulation.

A grinding device 9, which drives a grinding wheel 10, is arranged on the side of the circulation path 6 opposite the mouthpiece. The grinding wheel projects into the circulation path 6 in such a way that as the inclined surface of each knife 8 moves past, the knife face 11, is ground while passing the grinding wheel on each revolution so that the cutting edge 7 of each knife 8 is sharpened automatically on one side in a manner known per se.

Since the knives are shortened by grinding, so that eventually the cutting edges no longer circulate on the desired circulation path 6, but on a circular path with a smaller diameter than that of the circulation path 6, the knives must be automatically advanced in order that their cutting edges are continuously kept on the circulation path 6.

For the purpose of the automatic advance each component holding a knife in the knife holder is connected to an advancing gear system which is constructed as planetary gearing independent of the rotation of the knife carrier. The sun wheel 12 of the planetary gearing is situated on the geometrical axis of rotation of the rotating knife carrier, which is also the center of the circulation path 6. A planet wheel 13 is associated with each of the components holding a knife 8. The sun wheel 12 and the planet wheels 13 have a surrounding toothed belt 14 on common.

As indicated in broken lines in the case of the upper knife, which is situated exactly on the vertical axis extending through the center of the circulation path, the planet wheel 13 associated with this knife disposed exactly above acts upon an adjusting spindle 15 which as it rotates moves a split nut 16 which is connected to the knife 8, for example by way of a clamping shoe not shown in detail. For the sake of clarity the arrangement of the adjusting spindles is not shown in the case of the other knives.

The planet wheels 13 revolve with the rotating knife carrier and do not perform any individual rotation, provided the sun wheel likewise co-rotates uniformly. Only if the sun wheel is braked or accelerated, which may be caused for example by the rotating drive 17 shown diagrammatically, the planet wheels 13 are also rotated about their own axis by the toothed belt 14 and they also turn the adjusting spindles 15, so that there is an automatic advance of the knives 8 during their circulation on the circulation path 6.

The entire press together with the mouthpiece 5 may tilt downwards about the elevated axis 23 if overloading of the cutting tools occurs during cutting.

Figure 2:
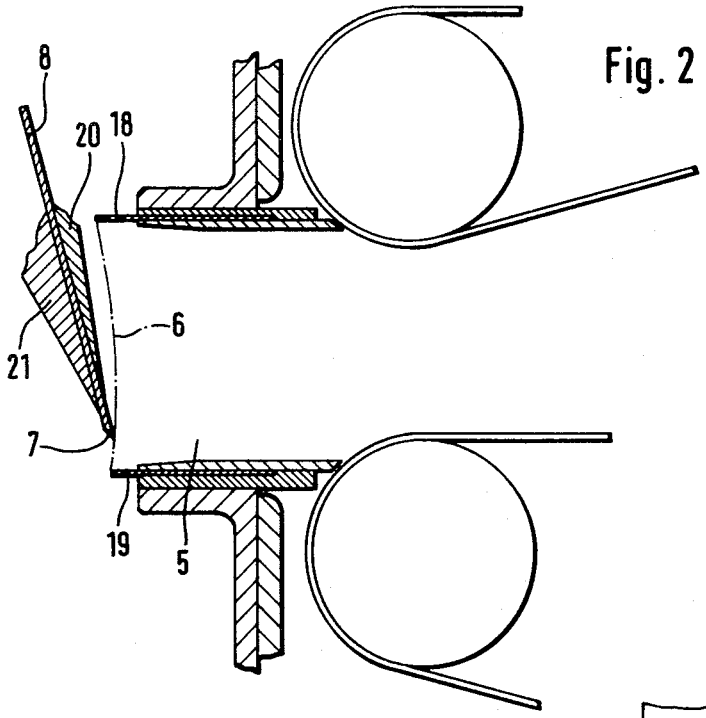
FIG. 2 is an enlarged, fragmentarily illustrated diagrammatic sectional view through the mouthpiece of the apparatus according to FIG. 1.

The mouthpiece 5 of the apparatus according to FIG. 1 is shown on an enlarged scale in FIG. 2. Counter knives 18 and 19, which are held clamped at one end and project with a free longitudinal edge not clamped into the circulation path 6 described by the cutting edges 7 of the knives 8, are disposed at the end of the mouthpiece at which the material to be cut emerges. The area of the counter knives which is not clamped may yield elastically resiliently. Each knife 8 is held clamped between two clamping jaws 20 and 21 of a knife clamp, the clamping jaw 21 projecting further towards the knife cutting edge 7 than the clamping jaw 20. In this way the knife is made more resistant to breakage.

Figure 3:
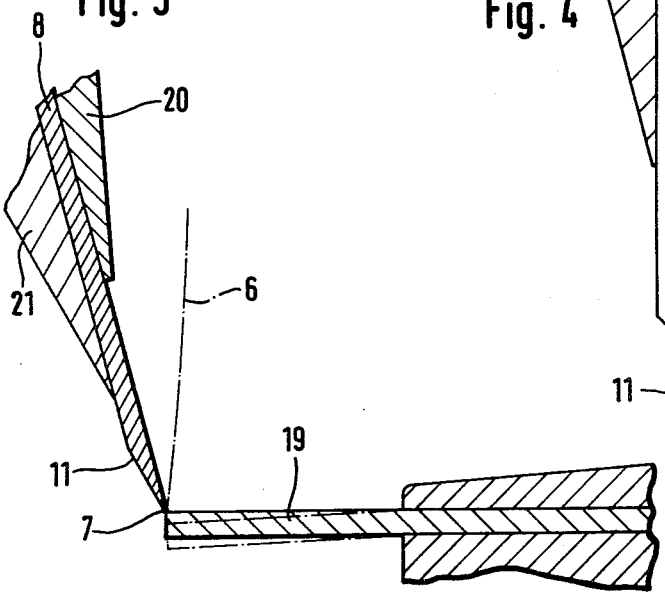
FIG. 3 is an enlarged sectional view of the cutting tools according to FIG. 2 during the cutting procedure.

A knife 8 moving past the counter knife 19 is shown once more on an enlarged scale in FIG. 3. The same components are provided with the same reference numerals as in FIG. 2. The cutting edge strikes the free resilient longitudinal edge of the counter knife 19 and deflects it downwards, as shown by dash-dot lines. The cutting edge 7 of the knife 8 and the longitudinal edge of the counter knife 19 are thus moved past one another in a sliding manner, so that a self-sharpening cut is produced in an advantageous manner.

Figure 4:
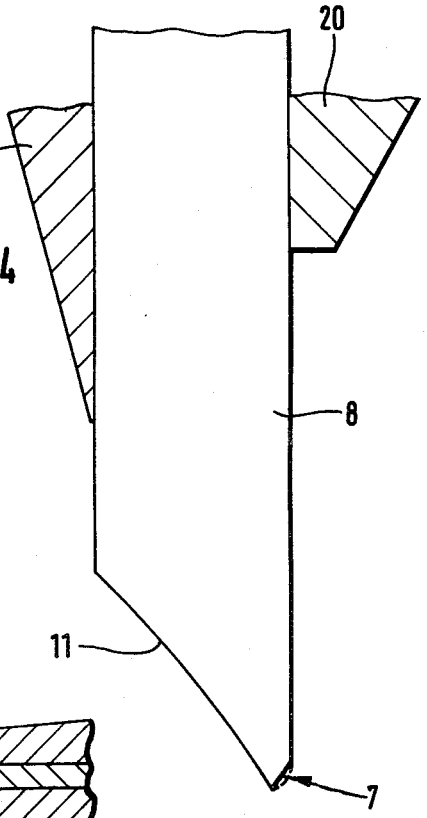
FIG. 4 is a further enlarged sectional view, in part elevation, of a cutting edge of a knife.

The performance of the sliding, self-sharpening cutting is illustrated in FIG. 4, in which a knife 8 is shown once more on an enlarged scale. The knife face 11 of the knife 8 held between the clamping jaws 21 and 20 is ground by the grinding device upon each revolution. In addition, during cutting, the cutting edge 7 is broken by the sliding counter knife on account of the action of the counter knife, as shown exaggerated in FIG. 4. Thus, by virtue of the steps according to the invention, the cutting edge 7 of the knife is sharpened on both sides, whereas it was only possible to sharpen on one side by the step known hitherto. By virtue of the fact that the always somewhat blunt cutting edge 7 of the knife is additionally broken and sharpened by the sliding counter knife, an acute, sharp cutting edge which cuts well is formed, and it allows a cutting in which the proportion of dust of the material to be cut is reduced.

Figure 5:
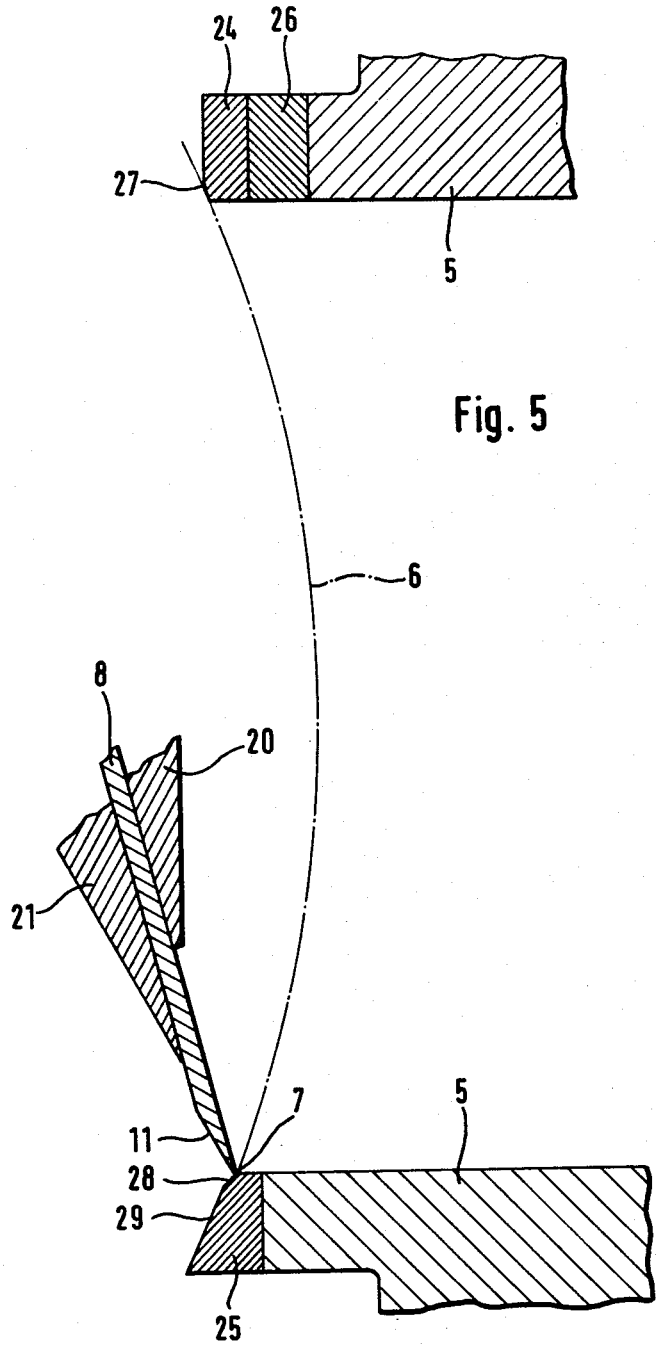
FIG. 5 is a diagrammatic sectional view of the mouthpiece of the apparatus with sliding strips according to a further embodiment of the invention.

In FIG. 5 the mouthpiece 5 of the apparatus is illustrated diagrammatically in cross-section. The same components are again provided with the same reference numerals. In this example of embodiment the sliding cutting of the cutting edges 7 of the knives 8 revolving around the path 6 are effected in accordance with a second solution in that sliding strips 24 and 25 projecting into the circulation path 6 are placed in front of the upper and the lower edge of the mouthpiece 5. The sliding strip 24 consists of carbide metal and is soldered to a connecting member 26 which may then be screwed for example in front of the edge of the mouthpiece. The drawing shows clearly how the front face 27 of the sliding strip 24 of carbide metal projects into the circulation path 6, so that each time a cutting edge 7 of a knife 8 passes the desired sliding action which improves the cutting takes place.

The strip 25 placed in front of the lower edge of the mouthpiece 5 may also consist of carbide metal and is then in turn held by a connecting member which is not shown here however. The upper edge—acting as a counter knife during cutting—of the lower sliding strip 25 is, as shown, provided with a bevel 28 of a greater or lesser inclination which deflects the cutting edge 7 of the knife 8 and consequently permits a sliding action over the surface 29 of the strip 25. The surface 29 may extend parallel to the circulation path 6. It may also be inclined in such a way that the contact pressure effecting the sliding action is increased or decreased.

A contact pressure effecting the sliding action may also of course be set by moving the entire mouthpiece forward towards the circulation path. For this purpose suitable adjusting device with spindles or the like may be provided, which are not, however, illustrated further here.

I claim:

1. In an apparatus for cutting plant material of the type having a funnel-shaped press having an outlet end in which the charged material to be cut is compressed, a mouthpiece arranged at the outlet end of the press to which the compressed material is fed, a rotatable knife carrier disposed in front of the mouthpiece and having a plurality of circulating knives having cutting edges which may be moved past the mouthpiece so as to perform a cutting action, and a knife-grinding device disposed in the circulation path of the knives having a grinding wheel disposed for operative passing engagement with an oblique knife surface of a knife face of the cutting edge of each knife which, when emerging from the mouthpiece, faces away from the material to be cut, the improvement comprising:

a plurality of elastically resilient counter knives disposed on said mouthpiece which project into the circulation path of the cutting edges of said knives, said counter knives being disposed on said mouthpiece to contact to sharpen an oblique knife surface of a knife face of the cutting edge of each knife facing the material to be cut.

2. The apparatus of claim 1, wherein each counter knife comprises a steel bar clamped on said mouthpiece, at least one longitudinal edge of which projects towards the circulation path of said cutting edges of said knives.

3. The apparatus of claim 1, wherein said knife carrier is rotatably mounted for movement about a horizontal axis.

4. The apparatus of claim 1, wherein said rotatable knife carrier has clamping elements, and wherein each knife is formed as a steel bar having a sharpened longitudinal edge acting as a knife cutting edge which is clamped in said clamping elements of said rotatable knife carrier.

5. The apparatus of claim 4, additionally including a clamping shoe which is movably guided in said rotatable knife carrier approximately transversely to the axis of rotation of the knife carrier and wherein the other longitudinal edge of each knife opposite said cutting edge is clamped in said clamping shoe.

6. The apparatus of claim 5, wherein said clamping shoe is combined with said associated knife and clamping elements to form a structural unit which is pivotably mounted in said rotatable knife carrier for pivotable movement about an axis extending parallel to the axis of rotation of said carrier.

7. The apparatus of claim 6, wherein said structural unit has associated guide means for pivoting purposes.

8. The apparatus of claim 7, additionally including at least one adjusting spindle for each knife which acts upon the associated clamping shoe to effect constant advancement of the associated knife.

9. The apparatus of claim 8, additionally including an advancing gear system connected to said adjusting spindle.

10. The apparatus of claim 9, wherein said advancing gear system comprises a set of planetary gears independent of the rotation of the knife carrier, including a plant wheel and a sun wheel.

11. The apparatus of claim 10, wherein said planet wheel of said set of planetary gears is secured to the pivoting axis of said structural unit and is associated with each adjusting spindle, wherein said sun wheel of said set of planetary gears is mounted on the axis of rotation of the knife carrier, wherein said sun wheel and said planet wheel are connected to one another by a toothed belt, and wherein said sun wheel is rotated by an advancing rotating drive effecting the advance of the knives.

12. The apparatus of claim 1, wherein said press may be tilted together with said mouthpiece about an axis orientated parallel to the axis of rotation of said knife carrier.

13. The apparatus of claim 12, wherein said press is supported on a disengageable support element having an adjustment device for the threshold value of a supporting force which effects disengagement in the event of overloading.

14. An apparatus for cutting plant material of the type having a funnel-shaped press having an outlet end in which the charged material to be cut is compressed, a mouthpiece arranged at the outlet end of the press to which the compressed material is fed, a rotatable knife carrier disposed in front of the mouthpiece and having a plurality of circulating knives having cutting edges which may be moved past the mouthpiece so as to perform a cutting action, and a knife-grinding device disposed in the circulation path of the knives having a grinding wheel disposed for operative passing engagement with an oblique knife surface of a knife face of the cutting edge of each knife which, when emerging from the mouthpiece, faces away from the material to be cut, the improvement comprising:

said mouthpiece having at least two relatively free upper and lower edges, at least one of which projects at least partially into the circulation path of said cutting edges of said knives and is formed by a free front face of a strip placed in front of the upper edge of said mouthpiece so as to contact to sharpen an oblique knife surface of a knife face of the cutting edge of each knife facing the material to be cut.

15. The apparatus of claim 14, wherein said knife carrier is rotatably mounted for movement about a horizontal axis.

16. The apparatus of claim 14, wherein said strip comprises carbide metal.

17. The apparatus of claim 14, wherein said free edge of said mouthpiece projecting into the circulation path comprises the lower edge of said mouthpiece which forms a lower counter knife having a bevel.

* * * * *